US006203229B1

(12) United States Patent
Coerver

(10) Patent No.: US 6,203,229 B1
(45) Date of Patent: Mar. 20, 2001

(54) BOLT ACTION RING BINDER ASSEMBLY

(76) Inventor: Charles B. Coerver, 6010 Old Lemay Ferry Rd., Imperial, MO (US) 63052

( * ) Notice: Subject to any disclaimer, the term of this patent is extended or adjusted under 35 U.S.C. 154(b) by 0 days.

(21) Appl. No.: 09/472,256

(22) Filed: Dec. 27, 1999

(51) Int. Cl.[7] ..... B42F 13/20

(52) U.S. Cl. ..... 402/38; 402/38; 402/36; 402/31; 402/20

(58) Field of Search ..... 402/36–42, 26, 402/31, 20

(56) References Cited

U.S. PATENT DOCUMENTS

| | | | | |
|---|---|---|---|---|
| 831,969 | | 9/1906 | Morden et al. . | |
| 842,851 | * | 2/1907 | Boden . | |
| 854,074 | * | 5/1907 | Bryant . | |
| 908,597 | | 1/1909 | Morden . | |
| 973,452 | | 10/1910 | Morden et al. . | |
| 973,932 | | 10/1910 | Fornoff et al. . | |
| 1,000,649 | | 8/1911 | Walker . | |
| 1,111,377 | | 9/1914 | Goss . | |
| 1,231,816 | * | 7/1917 | Veterling . | |
| 1,472,301 | | 10/1923 | Koepsell . | |
| 1,652,521 | | 12/1927 | Eifel . | |
| 2,073,049 | | 3/1937 | Dawson . | |
| 2,179,627 | * | 11/1939 | Handler . | |
| 2,322,595 | | 6/1943 | Schade . | |
| 2,543,866 | | 3/1951 | Panfil . | |
| 3,132,649 | | 5/1964 | Gits . | |
| 3,153,417 | * | 10/1964 | Newman . | |
| 3,255,759 | * | 6/1966 | Dennis . | |
| 3,270,749 | * | 9/1966 | O'Connell . | |
| 3,785,740 | | 1/1974 | Strong . | |
| 3,827,111 | * | 8/1974 | O'Connell | 402/36 |
| 3,954,343 | * | 5/1976 | Thomsen | 402/26 |
| 4,130,368 | * | 12/1978 | Jacoby et al. | 402/41 |
| 4,624,595 | * | 11/1986 | Ohminato | 402/34 |
| 4,690,580 | * | 9/1987 | Kissel | 402/39 |
| 4,854,763 | | 8/1989 | Jonsson . | |
| 5,116,081 | | 5/1992 | Mann, Jr. . | |
| 5,340,071 | * | 8/1994 | Fox, II | 248/231.8 |
| 5,393,156 | * | 2/1995 | Mullin et al. | 402/36 |
| 5,611,633 | | 3/1997 | Whaley . | |
| 5,692,847 | | 12/1997 | Zane et al. . | |
| 5,692,848 | * | 12/1997 | Wada | 402/39 |
| 5,782,569 | * | 7/1998 | Mullin et al. | 402/36 |
| 5,807,006 | * | 9/1998 | Cheung | 402/38 |
| 5,810,500 | | 9/1998 | Whaley . | |
| 5,868,513 | * | 2/1999 | Law | 402/31 |
| 5,895,164 | * | 4/1999 | Wu | 402/36 |
| 5,975,784 | * | 11/1999 | Whaley | 402/34 |

* cited by examiner

*Primary Examiner*—Henry Tsai
*Assistant Examiner*—Alisa L. Thurston
(74) *Attorney, Agent, or Firm*—Polster, Lieder, Woodruff & Lucchesi, L.C.

(57) ABSTRACT

A ring binder (100) has a center spine (102) and end leafs (104). A ring assembly (10) attaches to the spine includes a cover piece (12) and bolts (14, 16) on each of which are formed binder ring halves (18*a*–18*b*, 20*a*–20*b*, 22*a*–22*b*). The bolts are mounted on the cover piece and movement relative to each other to close and open the binder. A latching mechanism (50) formed on a distal end (44) of each ring half interlocks the ring halves together when the binder is closed. A guide finger (62) on each bolt aligns each bolt to the cover piece when the bolts are moved to close the binder rings, this action aligning the latching mechanism so the ring halves readily interlock with each other. A thumb pad (52) formed on each of the bolt releasably engages with the cover piece to lock the bolts in a binder ring closed position.

15 Claims, 7 Drawing Sheets

BOLT ACTION RING BINDER ASSEMBLY

CROSS-REFERENCE TO RELATED APPLICATIONS

This application is related to U.S. patent application Ser. No. 09/302,283 filed Apr. 30, 1999.

STATEMENT REGARDING FEDERALLY SPONSORED RESEARCH OR DEVELOPMENT

Not applicable.

BACKGROUND OF THE INVENTION

This invention relates to bolt action type ring binders, and more particularly, to an improved bolt action ring binder assembly and such an assembly integrally formed with a spine portion of a ring binder.

U.S. Pat. No. 5,975,785 which issued Nov. 2, 1999 and which is assigned to the same assignee as the present application, describes a bolt action type ring binder having, inter alia, a plurality of binder rings. The binder rings were constructed of two binder ring halves, one half being fixed and the other half being movable with respect to the fixed half. U.S. patent application Ser. No. 09/302,283, also assigned to the same assignee as the present application, described an improvement to this construction; specifically, a locking tab feature by which the bolt on which the movable ring halves are formed can be securely locked in a binder closed position. The invention described herein represents further improvements to a bolt action ring assembly to facilitate its manufacture, assembly, and ease of construction. In particular, there is described a bolt action construction in which both ring halves are now movable, in which the ring halves employ an interlocking construction, and which includes an alignment and improved locking construction for locking the binder in its closed position. In addition, there is described a bolt action ring metal which is integrally formed with a central, spine portion of the binder.

BRIEF SUMMARY OF THE INVENTION

Among the several objects of the present invention may be noted the provision of an improved bolt action ring assembly;

- the provision of such an assembly to comprise to two identically formed movable bolts each of which includes one-half section of a plurality of spaced binder rings for movement of either bolt to move one portion of the binder rings with respect to the other half to open and close the binder;
- the provision of such an assembly in which respective ring halves forming a binder ring include interlocking latching mechanisms for locking the halves together when the binder is closed to secure leaves of paper stored in the binder in place;
- the provision of such an assembly wherein each bolt has a locking mechanism formed at one end for locking the bolt in a ring closed position, the respective locking mechanisms each including an alignment tab for aligning the bolt in a preferred orientation when the bolt is locked in place;
- the provision of such an assembly in which the bolts are made of an acetal plastic material and the cover piece is made of polypropylene, so to form a lightweight assembly which is also sufficiently strong so the binder can hold a substantial amount of paper without the weight of the paper forcing the binder open; and,

- the provision of such an assembly in which the bolt action assembly and the spine portion of the binder cover are made as a single piece.

In accordance with the invention, generally stated, a bolt action ring binder assembly includes a cover piece formed of a molded plastic material. The binder includes a plurality of binder rings each of which is comprised of two interlocking ring halves. One set of ring halves is integrally formed on one bolt attachable to the cover, and the other set of ring halves is integrally formed on a separate bolt which also attaches to the cover. Both bolts are movable to move the ring halves relative to each other to open and close the binder. Each bolt further includes a locking tab formed at one end for securing the bolt to the cover in the ring locked position. An alignment finger is also formed at the end of the bolt where the locking tab is formed, and the cover includes a recess formed at each end in which a respective alignment finger is received to align the bolt relative to the cover. The bolts are formed so to be interchangeable and simplify assembly of the ring metal. In one embodiment, a base for the bolt action assembly forms a central, spine portion of the binder, to provide a one piece spine construction to which outer cover pieces of the binder are separately attachable. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figures 1, 2:
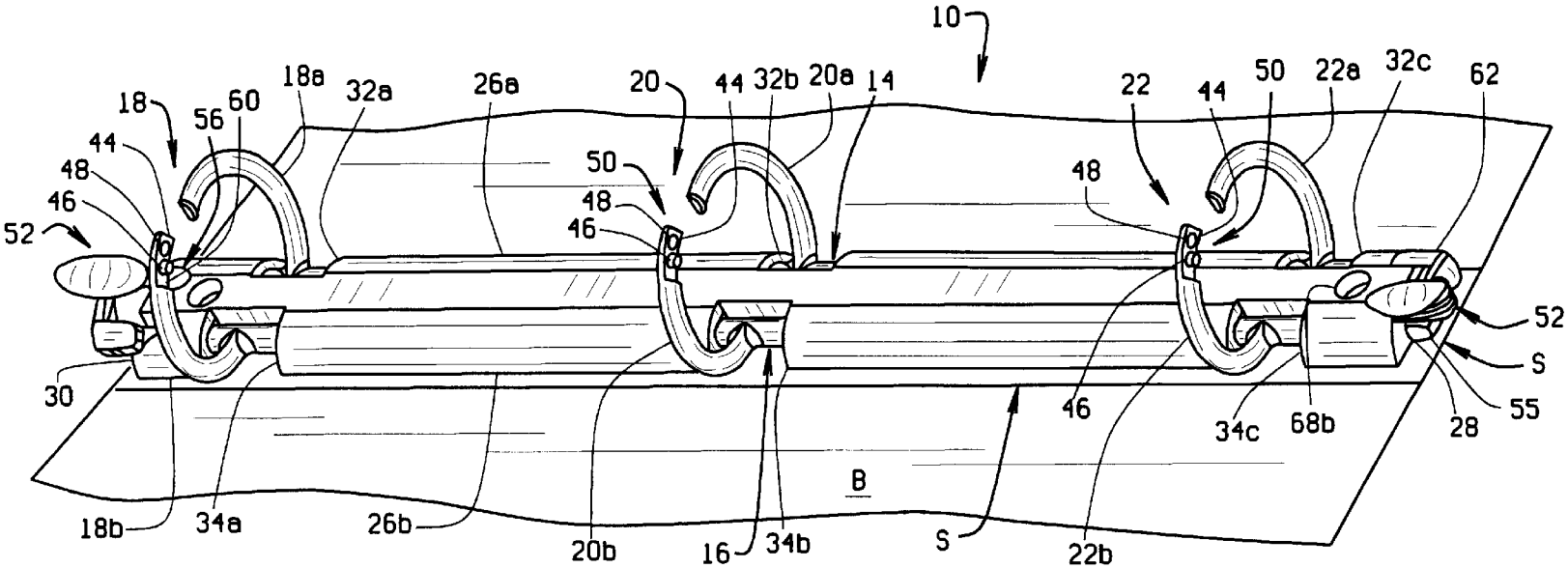
FIG. 1 is a perspective view of a bolt action ring assembly of the present invention, the ring metal being shown in its binder ring open position.
FIG. 2 is a top plan view of the assembly.
Figure 3A:
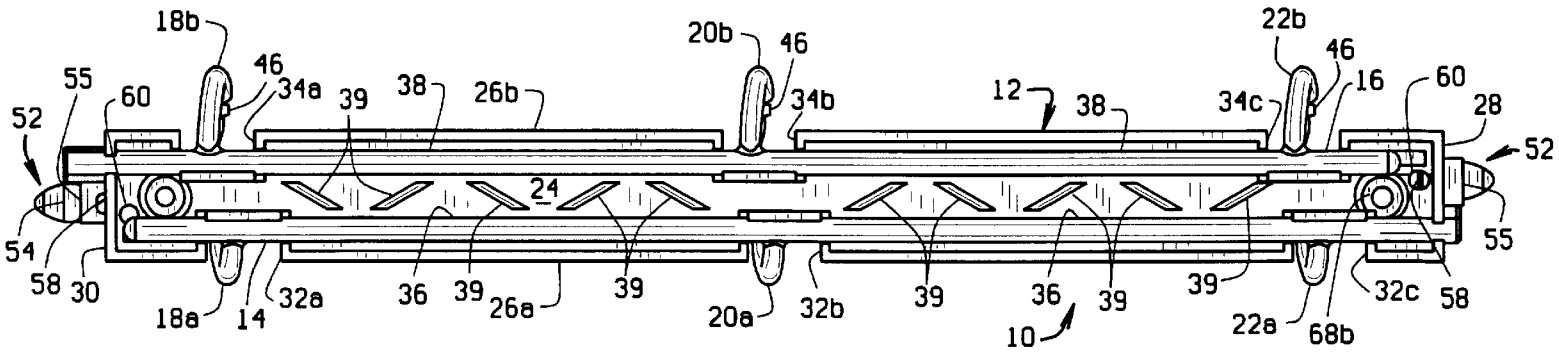
FIG. 3A is a bottom plan view of the assembly with the bolts on which ring sections are formed installed.
Figure 3B:
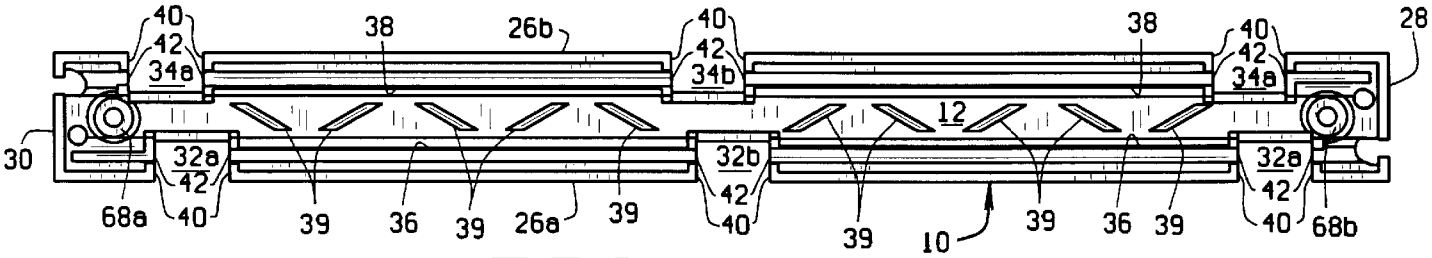
FIG. 3B is a similar view without the bolts installed.
Figure 4:
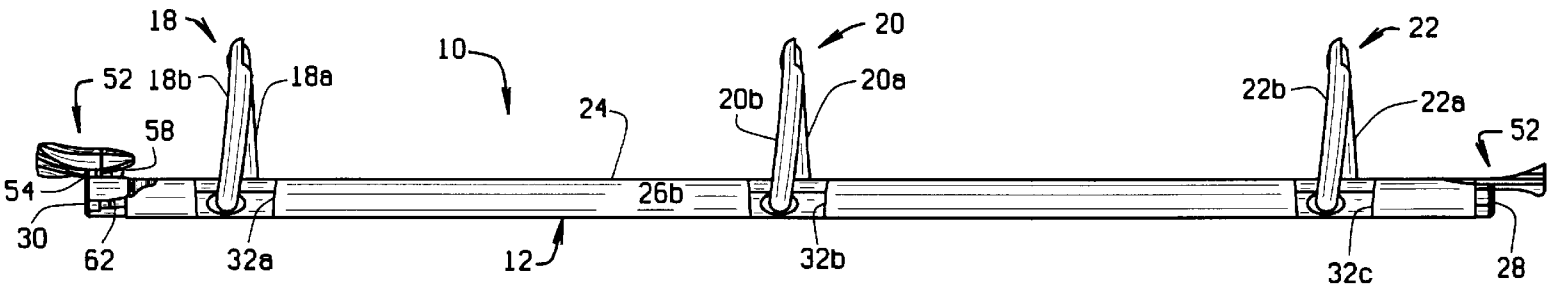
FIG. 4 is a side elevational view of the assembly.
Figure 5:
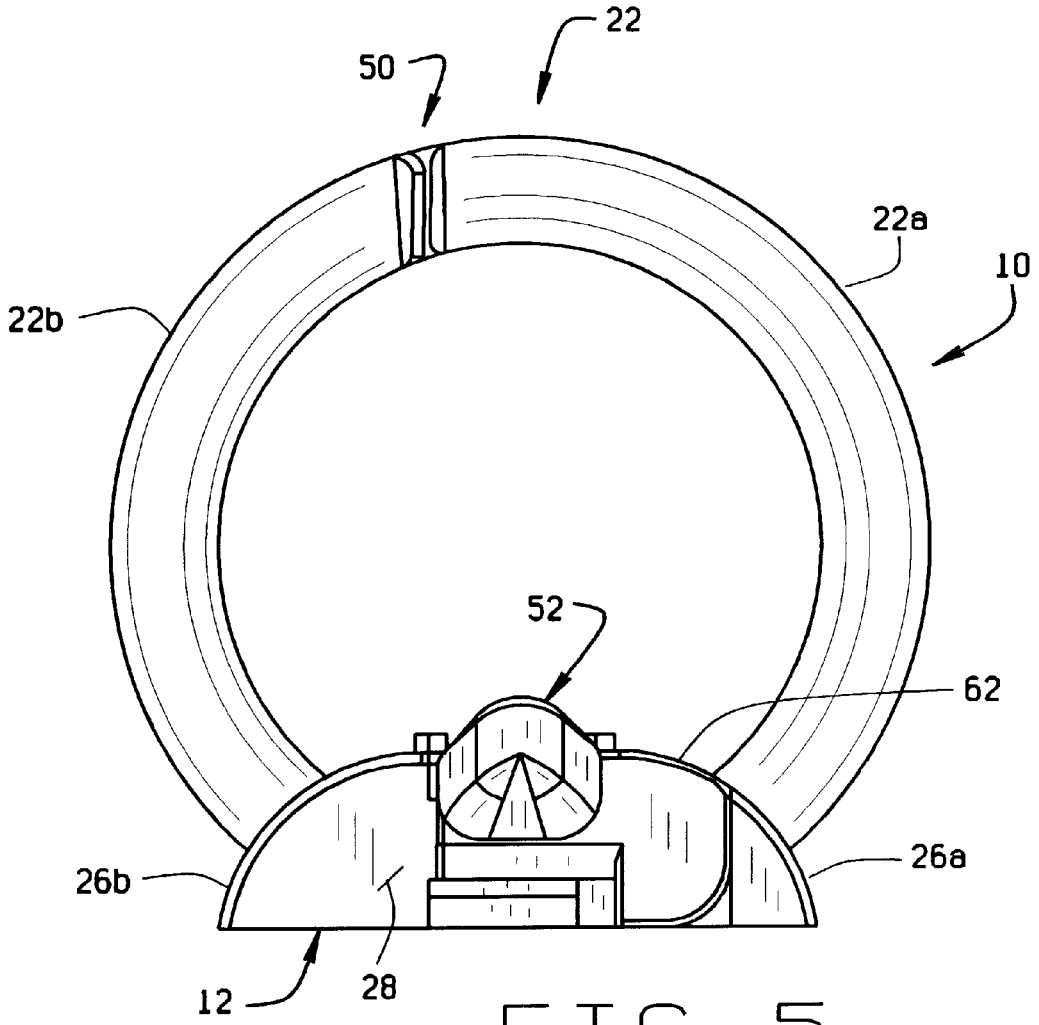
FIG. 5 is an end elevational view of the assembly.

Referring to the drawings, a bolt action ring binder assembly is indicated generally 10 and includes a cover piece 12 and bolts 14, 16 on which are integrally formed respective halves 18*a*–18*b*, 20*a*–20*b*, and 22*a*–22*b* of binder rings 18, 20, and 22. The cover plate and bolts are each preferably formed of a lightweight, yet strong plastic material. Preferably the cover piece is made of a copolymer material such as polypropylene, and the bolts of an acetal. This not only keeps the weight of assembly 10 to a minimum, but also allows the binder to hold a substantial quantity of paper without inadvertently opening. As shown in FIGS. 3A and 3B, cover plate 12 is shown to be of a molded construction; while, in FIGS. 6–8, the bolts 14, 16 and the respective ring halves are similarly shown to be of a single-piece molded construction.

Cover plate 12 has a flat central section 24 which extends longitudinally of the assembly the length of the cover plate. On both sides of this central section respective curved sidewalls 26*a*, 26*b* are formed. An endwall 28, 30 is formed at each end of the plate. A series of recesses are formed in each sidewall, recesses 32*a*, 32*b*, 32*c* in sidewall 26*a*, and recesses 34*a*, 34*b*, 34*c* in sidewall 26*b*. As shown in FIGS. 3A and 3B, respective channels 36, 38 are formed on the underside of cover 12, each channel extending horizontally of the cover plate, substantially the length of the plate. These Each channel is formed in the underside of one of the plate sidewalls and is sized to receive one of the bolts 14, 16 and facilitate reciprocal movement of the bolts both longitudinally of the cover plate, as well as rotary movement of the bolt. The bolts 14, 16 are circular in cross-section. Channels 36, 38 are generally semi-circular in shape and the diameter of the channels corresponds to the diameter of the bolts for the bolts to slidingly and rotatingly received in the channels. Reinforcing ribs 39 are formed between the channels to strengthen the cover piece. As shown in FIGS. 3A and 3B, these ribs extend the length of the cover. As further shown in FIG. 3B, each recess in the respective sidewalls of the cover plate has end walls 40 at each end in which are formed openings 42 sized for the bolts, when installed, to move freely back and forth as a rotationally. This allows the bolts to be moved relative to each other; first longitudinally to move the respective halves forming a binder ring to move away from each other, and then for one of the bolts to be rotated so that one ring half is rotated away from the other a distance sufficient to readily allow the pieces of paper to be stored in, or removed from, the binder in which the assembly is installed.

Figure 8:
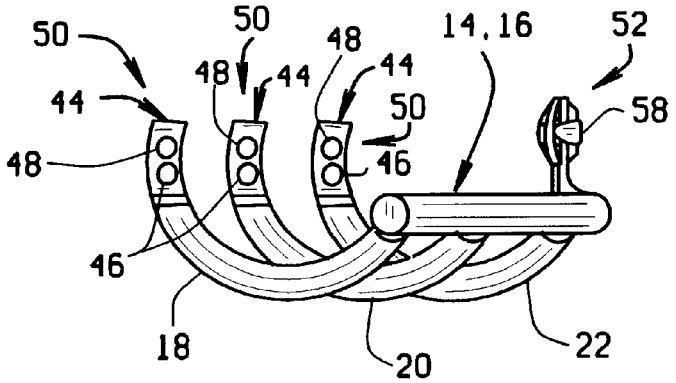
FIG. 8 is a perspective view of the bolt.
Figure 6:
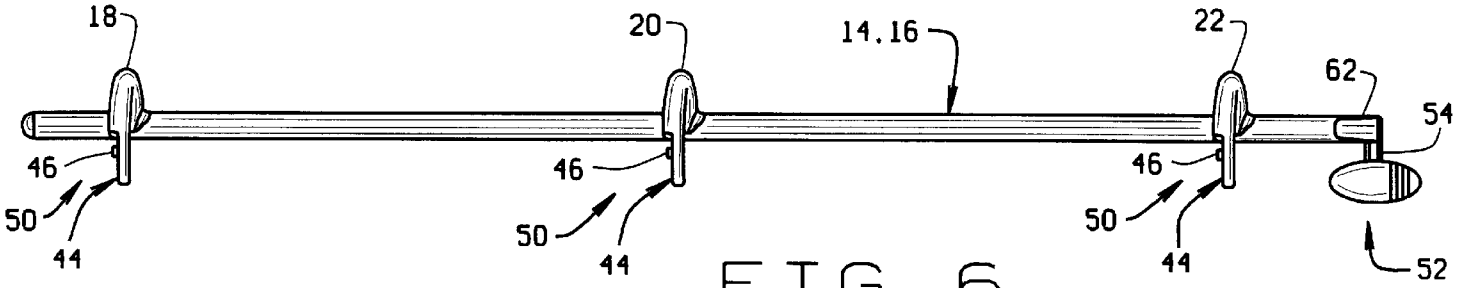
FIG. 6 is a top plan view of a bolt installed in the assembly.
Figure 7:
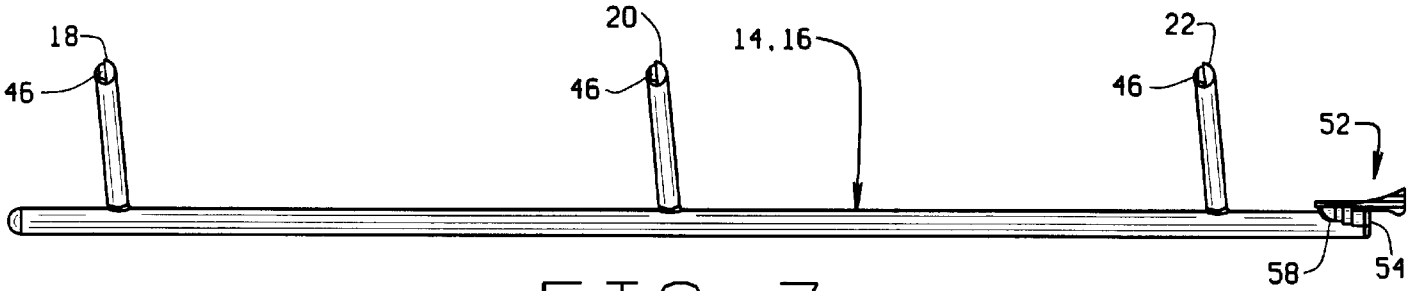
FIG. 7 is a side elevational view of the bolt.

Referring to FIGS. 6–8, each bolt 14, 16 has, as noted, one half of a binder ring formed it. Each binder ring half matingly latches with a binder ring half formed on the other bolt. As shown in the drawings, the binder ring assembly has three binder rings and so there are three binder ring halves integrally formed with each bolt. The ring halves are spaced along the length of each bolt so that there is one ring formed generally at each end of the assembly, as well as in the middle thereof. Further, the ring halves are not formed of straight segments, but rather the ring halves are curved along their length. This is to facilitate latching and unlatching of the respective halves to close and open the rings. Further, as best shown in FIGS. 3A and 3B, the recesses formed the respective sidewalls of cover 12 do not align with each other, but rather are offset. In each instance, the amount of offset is uniform from set of opposed recesses to the other, and all of the recesses are offset in the same direction. Referring to FIG. 6, at the distal end of each ring half, there is a flattened section indicated generally 44. Toward the inner end of each flattened section there is formed a circular pin 46, and at the outer end of the section is formed a circular recess 48 whose diameter corresponds to that of the pin and whose depth corresponds to the height of the pin. The pins and recesses together form a latching means 50 by which the respective ring halves interlock with each other to close the binder rings. The respective bolts 14,16 are identically formed and thus are interchangeable with each other. Further, the construction of the cover is such that the bolts move in opposite directions to each other; although, it will be understood by those skilled in the art, that only one bolt has to be moved in order to unlatch and open the binder rings and latch and close them.

Figure 9:
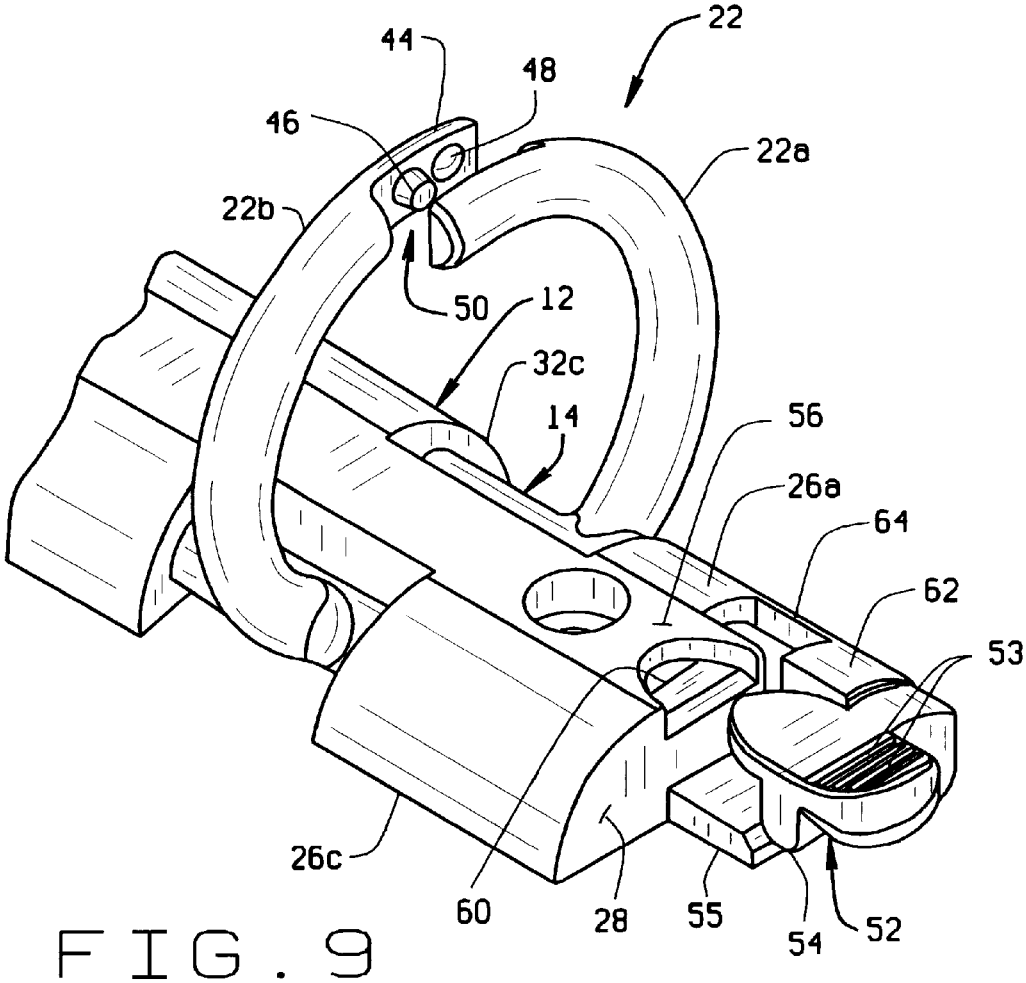
FIG. 9 is a perspective view of one end of the cover plate illustrating a thumb pad release and guide finger portion of the assembly.
Figure 10:
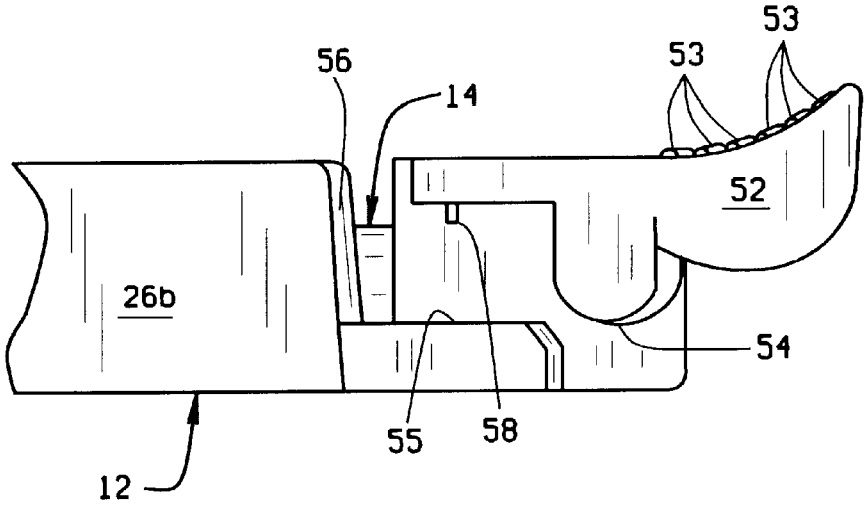
FIG. 10 is an elevational view of the end of the assembly shown in FIG. 9, better illustrating the thumb pad release.

At one end of each bolt there is formed a thumb operated release indicated generally 52 by which a bolt can be locked in place and prevented from inadvertently being moved. As shown in FIGS. 6, 8, 9 and 10, release 52 is a thumb pad integrally formed with the bolt. The release has a generally oval shape, when viewed in plan, and as shown in FIG. 10, the outer end of the release is greater in height then the inner end thereof. The upper surface of the release is contoured to generally conform to the shape of a person's thumb pad and the outer end of the upper surface includes a series of ridges 53 extending orthogonally of the pad to facilitate gripping of the pad. This makes it easy for the person to actuate the bolt by pressing on the release. An ear 54 depends from the underside of the release. A shelf 55 extends rearwardly of end 28 of the cover piece and the bottom of the ear rides upon an upper surface of the shelf as the release is moved back and forth with the bolt 14,16.

A recess 56 is formed at each end of cover 12. The recess has a shape conforming to that of the inner end of release 52 for this end of the release to fit in the recess. Each recess is formed in the flat surface section 24 of the cover. A pin 58 is formed on the underside of release 52, and a cavity 60 is formed in the base of recess 56 at the inner end of the recess. Pin 58 fits in this recess to capture and hold the release in place. In operation, the user presses down on the back of release 52 which rotates the front end of the release upward freeing pin 58 from cavity 60. In will be appreciated that this action only releases the bolt to be moved. This action, in and of itself, does not move the bolt are cause either rotationally or longitudinally, so the binder rings remain closed. The bolt is now, however, freely movable by the user to open and close the binder. When the binder rings are closed and interlocked, release 52 is positioned above recess 56. By pressing down on the front end of the release with their thumb, the user pushes pin 58 into opening 60 to lock the bolt in place.

Also integrally formed with bolt 14, 16 is a guide finger 62. The finger is formed at the same end of the bolt as release 52 and extends longitudinally of the bolt, above the bolt. As best shown in FIG. 9, a slot 64 is formed in the each end of cover plate 12 on the other side of the cover piece from recess 56. The slot is a longitudinally extending slot and is sized and shaped for the guide finger to be received in the slot when the user moves the bolt in the direction to close the binder rings. Guide finger 62 is an alignment feature to facilitate latching of the binder ring halves when the rings are to be closed. That is, when the user wants to close the rings, he rotates a bolt to its position where guide finger 62 is aligned with slot 64. Now, longitudinal movement of the bolt inserts the guide finger in the slot. At the same time, the latching pins 46 on the binder ring halves formed on the bolt should insert into the holes 48 in their companion ring halves formed on the other bolt because alignment of the fingers with respective pockets simultaneously, and automatically, aligns the latching means on the binder rings.

Figure 11:
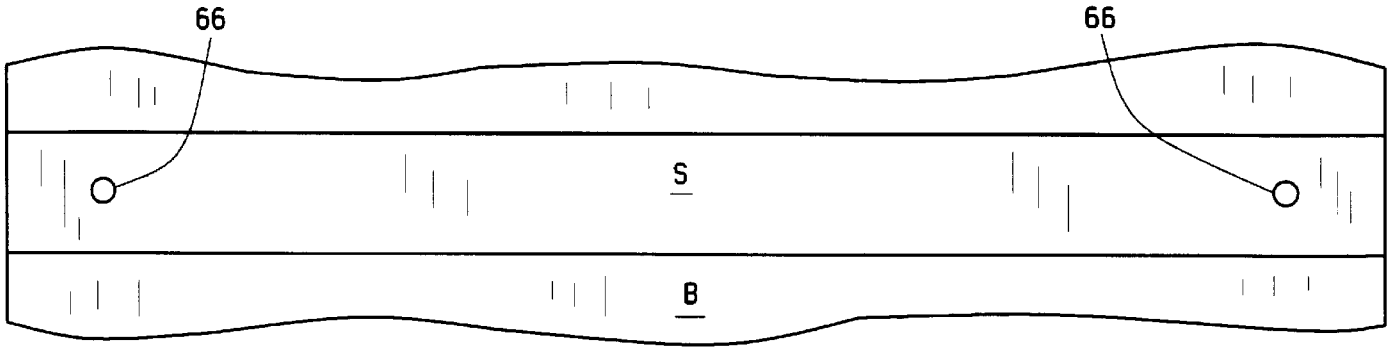
FIG. 11 is a plan view of a spine portion of the binder to which the binder ring assembly is attached.
Figure 12:
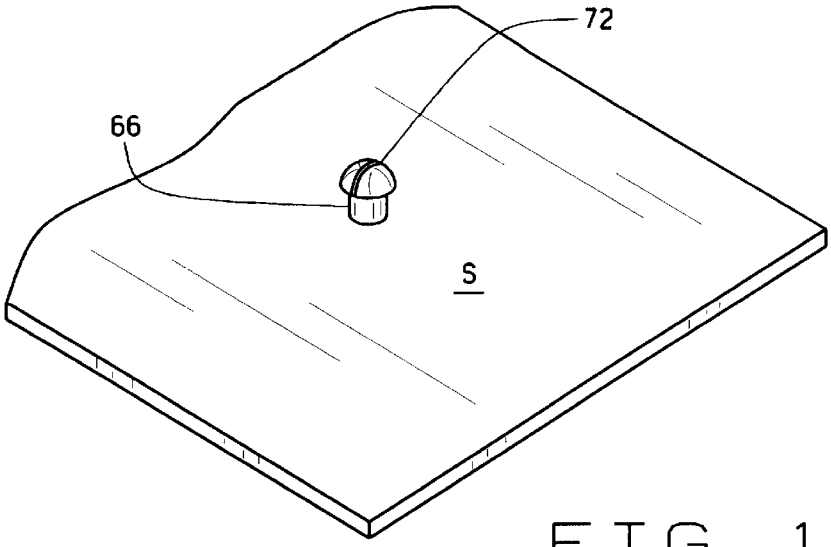
FIG. 12 is perspective view of a portion of a binder spine on which a rivet for attaching the binder ring assembly to the spine is integrally formed.

Binder ring assembly 10 is fastened to the spine S of a binder B in a number of ways. As shown in FIG. 11, a pair of fasteners such as rivets 66 are used to attach the assembly to the spine of the binder. Holes 68*a,* 68*b* are formed at respective ends of the cover plate. The fasteners are each attach to the cover through these holes with the other end of the fasteners attaching to the binder spine. Alternatively, and as shown in FIG. 12, if the binder is also made of a plastic, the rivets can be integrally formed with the binder spine. Now, the assembly is attached by "snap fitting" it in place. That is, the cover plate is pressed down onto the heads 72 of the rivets which are forced through the openings 68. When the rivet heads clear the openings, the assembly is fitted in place.

Figure 13:
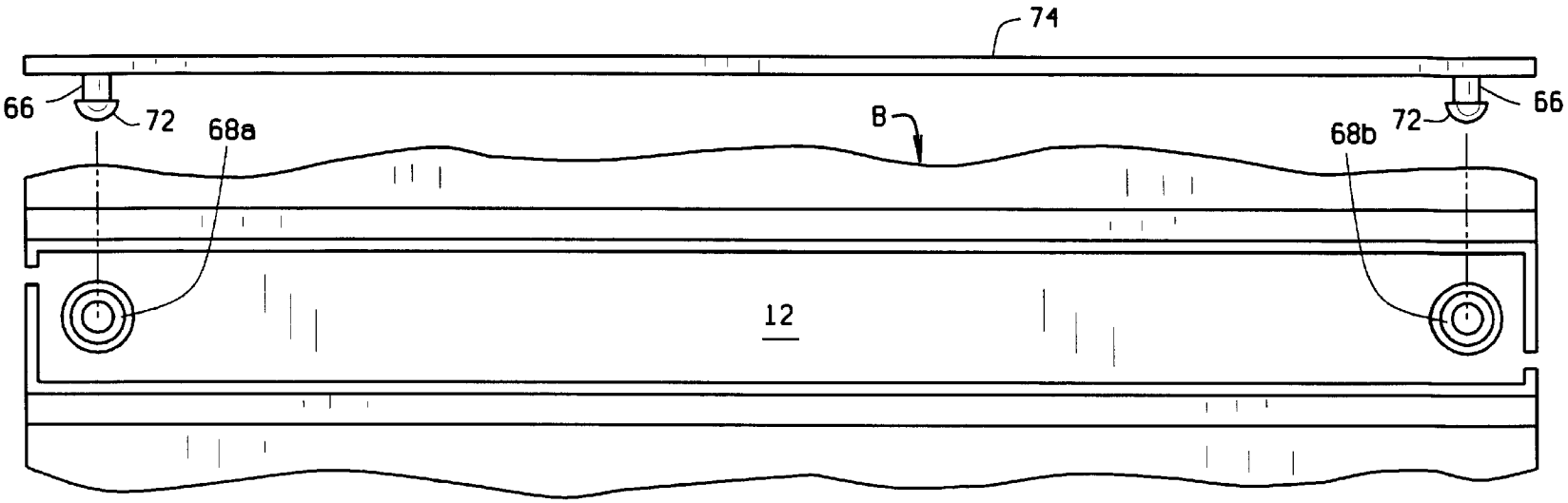
FIG. 13 is a bottom plan view of an alternate spine construction in which the cover piece of the assembly is integrally formed as part of the spine with a cover piece which is installed over the bottom of the binder ring assembly.

Another binder construction is shown in FIG. 13. In this embodiment, the cover plate 12 for the binder ring assembly is integrally formed as part of the binder spine. For clarity in FIG. 13, only a simplified plan view of the underside of the cover is shown. Now, after the bolts 14, 16 are mounted in place, a backing plate 74 including integrally formed rivets 66 is installed to the exposed backside of the cover. As before heads 72 on the rivets are inserted into holes 68*a,* 68*b* formed in the cover. When the backing plate is "snap fitted" in place, it covers the outside of the binder spine forming a completed binder assembly.

Figure 14:
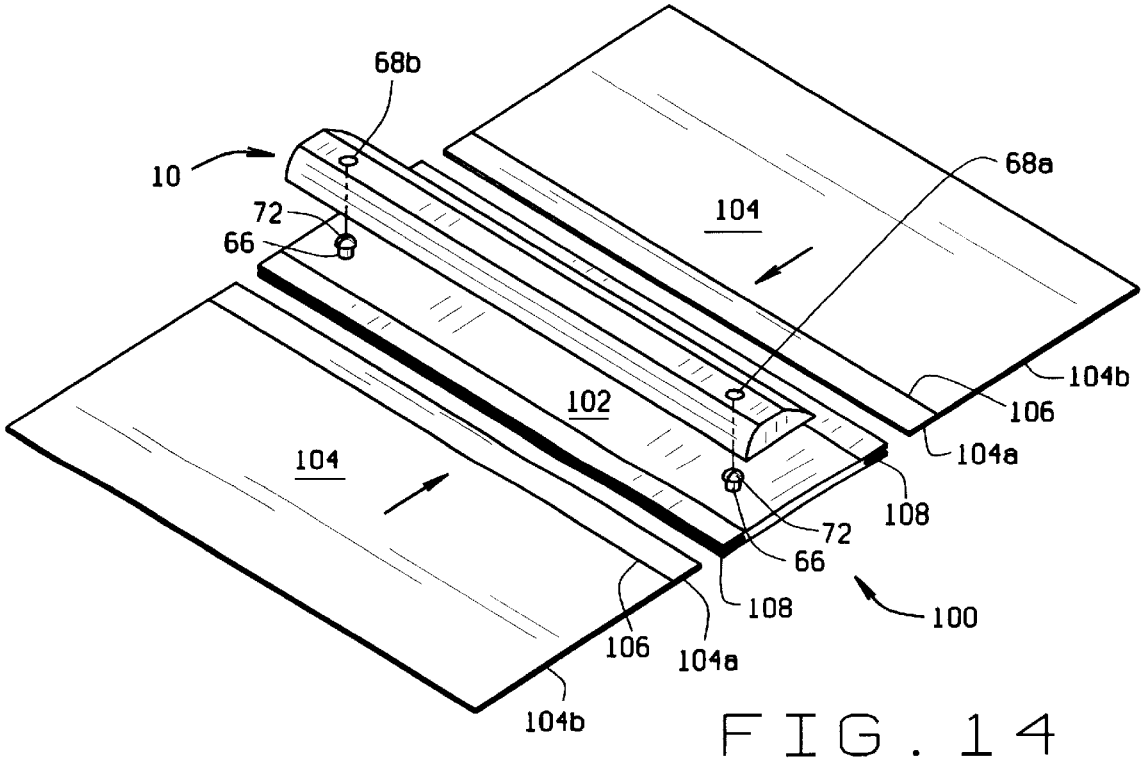
FIG. 14 is a perspective view of a modular ring binder with which the binder ring assembly is used; and, FIG. 15 is an end elevational view of the modular ring binder illustrating installation of leaf members to a spine portion of the binder.
Figure 15:
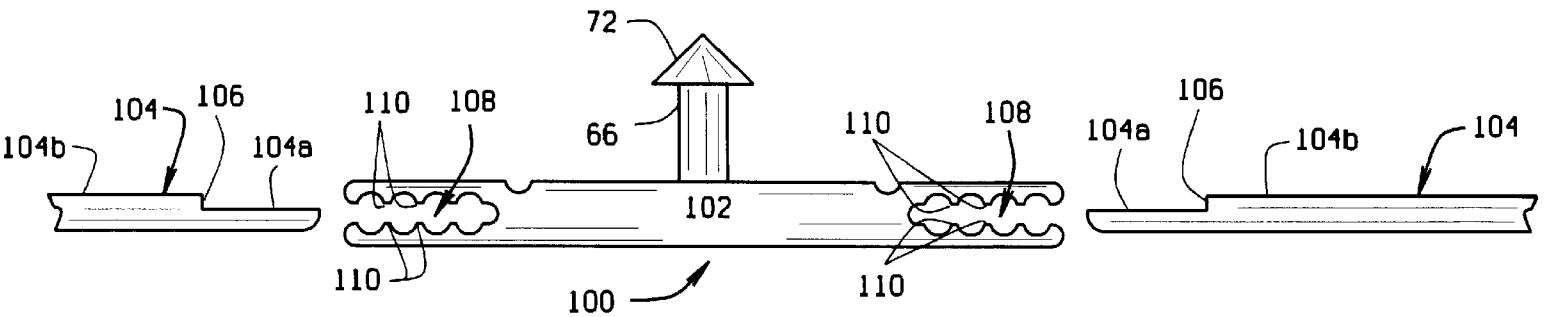

Finally, referring to FIGS. 14 and 15, a binder 100 includes a spine 102 including the rivets 66 at each end. As shown in FIG. 14, assembly 10 is attachable to the spine in the manner preciously described. The binder has an outer leaf 104 which is made of plastic material and two such leafs are attachable to opposite side of spine 102 to form a completed binder. Each leaf 104 has an inner section 104*a* of a first thickness, and an outer section 104*b* of a second and greater thickness. A shoulder 106 is formed at the junction between the two sections. As shown in FIG. 15, the thinner section 104*a* of each leaf fits into a jaws 108 formed on each side of spine 102 and extending the length of the spine section (see FIG. 14). Section 104*a* of a leaf is inserted in the jaws section of spine 102. Each set of jaws includes serrations 110 which grip the sides of leaf section 104*a* to frictionally engage the leaf and keep it permanently in place. Alternately, the leafs can be permanently secured to the spine by gluing the two pieces together, press fitting them together, or heating them to create a bond between them. An advantage of the binder construction shown in FIGS. 14 and 15 is that the spine can be used with a wide variety of leafs. That is, different widths of leafs can be used with a common spine to form different size binders.

What has been described is a bolt action ring binder having two bolts separately attachable to a cover plate portion of the binder. The binder has a plurality of binder rings each of which comprises a pair of ring halves with one ring half formed on one bolt and the other ring half on the other bolt. The ring halves have interlocking latching mechanisms to latch the rings together when the binder is closed. Each bolt has a locking mechanism formed at one end for locking the bolt in a binder closed position. This bolt also includes an alignment tab for aligning the bolt with the cover piece when the binder is to be closed. The base to which the bolts are mounted, and a cover plate fitting over the plate, are formed of a lightweight plastic material so to reduce the weight of the assembly while to providing an assembly sufficiently strong that the binder can hold a substantial amount of paper. Various binders employing the bolt action assembly can be constructed such that common parts can be used to make binders of different sizes.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A bolt action ring assembly for use in a ring binder comprising:

a cover piece;

a pair of bolts on each of which are formed portions of at least one binder ring, the bolts being mounted to said cover piece for movement relative to each other to move the binder ring portions formed thereon into and out of contact with each other to close and open the ring binder;

latching means formed on a distal end of each ring portion for interlocking the portions together when the binder ring is closed; and, guide means formed on each bolt for aligning each bolt with respect to the cover piece when the bolts are moved in a direction to close the binder ring, aligning of the bolts further aligning the latching means whereby the ring portions on each bolt readily interlock with each other to latch the ring in a closed position; and a user operable release for locking a bolt in a binder ring closed position and for releasing the bolt when the binder is to be opened, said release comprising a thumb pad attached to said bolt by an arm, said release being receivable in a recess formed in said cover piece, an outer end of the release being greater in height then an inner end thereof, and an upper surface of the release being contoured to generally conform to the shape of a person's thumb pad to facilitate operation by a user when the user presses on the release with their thumb or finger, said recess having a shape generally conforming to that of an inner end of said release for this end of the release to fit into said recess, and a pin formed on an underside of the release and an opening formed in a base of the recess, the pin fitting into the opening to capture and hold the release in place, a user pressing down on the back of the release to raise the inner end thereof upward and releasing the pin from the opening to free the bolt for movement by the user.

2. A bolt action ring assembly for use in a ring binder comprising:

a cover piece formed of a copolymer material such as polypropylene;

a pair of bolts on each of which are formed portions of at least one binder ring, the bolts being mounted to said cover piece for movement relative to each other to move the binder ring portions formed thereon into and out of contact with each other to close and open the ring binder, the bolts being formed of an acetal material;

latching means formed on a distal end of each ring portion for interlocking the portions together when the binder ring is closed; and, guide means formed on each bolt for aligning each bolt with respect to the cover piece when the bolts are moved in a direction to close the binder ring, aligning of the bolts further aligning the latching means whereby the ring portions on each bolt readily interlock with each other to latch the ring in a closed position.

3. The assembly of claim 2 wherein each ring portion comprises one half of a binder ring which is integrally formed with the bolt, the bolt being movable both longitudinally and rotatably when mounted to the cover piece for the binder ring portions to be movable relative to each other.

4. The assembly of claim 3 wherein the ring binder includes a plurality of binder rings each formed by a pair of binder ring halves one of which is integrally formed on one of the bolts and the other of which is formed on the other bolt.

5. The assembly of claim 2 wherein the distal end of each binder ring half has a flat section and the latching means is formed on said flat section.

6. The assembly of claim 5 wherein said latching means includes a recess formed at the outer end of said flat section and a pin formed on said flat section inwardly from said recess.

7. The assembly of claim 6 wherein said the diameter of said pin and the height thereof correspond to the diameter of said recess and the depth thereof for a pin formed on one ring half to fit into the recess formed on the other ring half to interlock the ring halves and latch them together.

8. The assembly of claim 2 wherein said guide means includes a finger formed on said bolt, said cover piece including a slot in which said finger is received when the bolt is moved to close the binder ring.

9. The assembly of claim 8 wherein the finger is integrally formed on said bolt and said slot is formed in said cover piece so that when said bolt is rotated to a preferred orientation the finger is received in the slot, longitudinal movement of the bolt thereafter automatically interlocks the latching means on the distal end of said ring portions.

10. A ring binder comprising:

an outer cover including a center spine portion and end leafs extending from each side of the spine; and, a ring assembly attached to the spine, the ring assembly including a cover piece, a pair of bolts on each of which are formed portions of at least one binder ring, the bolts being mounted to said cover piece for movement relative to each other to move the binder ring portions formed thereon into and out of contact with each other to close and open the ring binder, latching means formed on a distal end of each ring portion for interlocking the portions together when the binder ring is closed, a finger guide means formed on each bolt for aligning each bolt with respect to the cover piece when the bolts are moved in a direction to close the binder ring, aligning of the bolts further aligning the latching means whereby the ring portions on each bolt readily interlock with each other to latch the ring in a closed position; and, a release means formed on each of the bolts and releasably engaging the cover piece to lock the bolts in a binder ring closed position, said release means including a thumb pad attached to said bolt by an arm and receivable in a recess formed in said cover piece, an outer end of the pad being greater in height then an inner end thereof, and an upper surface of the pad being contoured to generally conform to the shape of a person's thumb pad to facilitate operation by a user when the user presses on the pad with their thumb or finger, said recess having a shape generally conforming to that of an inner end of said pad for this end of the pad to fit into said recess, a pin formed on an underside of the pad and an opening formed in a base of the recess, the pin fitting into the opening to capture and hold the pad in place, a user pressing down on the back of the pad raising the inner end thereof upward and releasing the pin from the opening to free the bolt for movement by the user.

11. The ring binder of claim 10 further including a plurality of binder rings each formed by a pair of binder ring halves one of which is integrally formed on one of the bolts and the other of which is formed on the other bolt.

12. The ring binder of claim 11 wherein the distal end of each binder ring half has a flat section on which said latching means is formed, said latching means including a recess formed at the outer end of said flat section and a pin formed on said flat section inwardly from said recess, the diameter of said pin and the height thereof corresponding to the diameter of said recess and the depth thereof for a pin formed on one ring half to fit into the recess formed on the other ring half to interlock the ring halves and latch them together.

13. The ring binder of claim 10 wherein said guide means comprises a finger integrally formed on each bolt, said cover piece including a slot formed therein so when said bolt is rotated to a particular orientation the finger is received in the slot, with longitudinal movement of the bolt thereafter automatically interlocking the latching means on the distal end of said ring portions.

14. The ring binder of claim 10 which said cover is formed of a copolymer material such as polypropylene.

15. The assembly of claim 14 in which said bolts are formed of an acetal material.

* * * * *